US011389801B2

(12) United States Patent
Tsai

(10) Patent No.: US 11,389,801 B2
(45) Date of Patent: Jul. 19, 2022

(54) CELL STORAGE TUBE

(71) Applicant: UNICOCELL BIOMED CO., LTD., Taipei (TW)

(72) Inventor: James Tsai, Taipei (TW)

(73) Assignee: UNICOCELL BIOMED CO., LTD., Taipei (TW)

( * ) Notice: Subject to any disclaimer, the term of this patent is extended or adjusted under 35 U.S.C. 154(b) by 374 days.

(21) Appl. No.: 16/779,696

(22) Filed: Feb. 3, 2020

(65) Prior Publication Data

US 2021/0237056 A1 Aug. 5, 2021

(51) Int. Cl.
*B01L 3/00* (2006.01)

(52) U.S. Cl.
CPC ..... *B01L 3/50825* (2013.01); *B01L 2300/041* (2013.01); *B01L 2300/0832* (2013.01); *B01L 2300/12* (2013.01)

(58) Field of Classification Search
CPC ..... B01L 3/50825; B01L 2300/041; B01L 2300/0832; B01L 2300/12; B65D 17/00; B65D 39/00; B65D 39/0052; A61B 5/15003; A61B 5/150351; A61B 5/154
See application file for complete search history.

(56) References Cited

U.S. PATENT DOCUMENTS 10,618,044 B1 * 4/2020 Petrie, Jr. ..... B01L 3/50853
2013/0167768 A1 * 7/2013 Smith ..... A61B 5/1411 422/550
2019/0300249 A1 * 10/2019 Tsang ..... B65D 55/028

FOREIGN PATENT DOCUMENTS

CN 108338794 A * 7/2018 ..... A61B 5/15003
WO WO-2015193830 A1 * 12/2015 ..... A61J 1/1406

* cited by examiner

*Primary Examiner* — Shawn M Braden
(74) *Attorney, Agent, or Firm* — WPAT, PC

(57) ABSTRACT

The invention provides a cell storage tube, having: a main body including an accommodating chamber, an opening end and a closed end; a sealing member disposed at the opening end and sealing the accommodating chamber, the sealing member including an assembly part coupled to the main body, an end of the assembly part having a guiding chamber such that a lower part of the assembly part having an outer diameter gradually reduced in a downward direction, and an insertion part having a reticle arranged on a top thereof; a cover body disposed at the opening end, one side of the cover body configured with a through hole; and a sealing cover disposed on a top of the cover body and detachably coupled with the cover body, wherein the sealing cover closes the through hole of the cover body when the sealing cover is combined with the main body.

13 Claims, 6 Drawing Sheets

CELL STORAGE TUBE

BACKGROUND OF THE INVENTION

1. Field of the Invention

The present invention relates generally to a storage container, and more particularly, to a container for storing cells.

2. The Prior Arts

Cell storage technology aims to store healthy cells by certain means to ensure the function and activation of the cells not be materially altered. Stored cells could be used in treatment on oneself or family when disease is diagnosed, or in experimental researches.

For example, the number of stem cells in human body decreases with age, degrading their performance for tissue repair, cell generation and differentiation. Thus, it is recommended to store one's own stem cells in young age when stem cells still remain great in number. Besides, it is likely to find immune cells from a person with cancer be severely damaged due to invasion of cancer cells and destructive chemical treatments. In absence of healthy immune cells, efficacy of treatment may be limited; thus, it is worth considering storing healthy immune cells early.

In general, cells needed to be store in a low temperature environment, for example, in liquideous nitrogen (−196° C.). Considering that either storage of cells into the storage tubes or extraction of cells from the tubes for usage requires to be performed under a sterile condition, and that cell extraction may be performed with multiple accesses to the storage tube, rather than an one-time incident, it is important to ensure the convenience of cell extraction and at the same time prevent cells in the storage tube from being contaminated due to multiple accesses for extraction.

A conventional cell storage container normally includes a storage tube main body for accommodating cells and a sealing plug for sealing the main body. A user removes the sealing plug from the main body to put in or take out cells. However, in order to tightly seal the main body, the sealing plug is often difficult to be removed, making the usage of the cell storage container inconvenient. Moreover, with such configuration, the sealing state of the main body is released during cell extraction and thus cells in the main body may be contaminated.

It is known that there has been developed a type of cell storage container which includes a storage tube, a sealing member for sealing the storage tube, and a sealing cover covering the sealing member. Since the sealing member is utilized on the cell storage container to seal the storage tube, in order to extract cells, a pin may penetrate the sealing member to obtain cells in the storage tube; furthermore, as the sealing cover is merely served to cover the sealing member, it may be designed as a structure easy to be opened, thereby facilitating the operation of the container. Yet, during the insertion of the pin through the sealing member, it is frequent that the pin could not align with the center of the tube and happens to collide with wall of the storage tube, causing damage of the pin. In addition, when cells have been put into the tube ready for sealing, it is often difficult for the sealing member to be inserted into the storage tube; the sealing member may encounter deformation or damage during insertion.

SUMMARY OF THE INVENTION

A primary objective of the present invention is to provide a cell storage tube which is simple and convenient in assembly. By configuring a guiding chamfer on the sealing member, the user is allowed to easily insert the sealing member into the main body of the storage tube and seal the cells within the main body. In addition, the main body of the storage tube is always remained in a closed and sealed state in the process of cell extraction from the main body, preventing the cells in the main body of the storage tube from being contaminated and allowing the storage tube to be maintained in a sterile state. Furthermore, the insertion of the pin is assured to be inserted from the center of the insertion part by utilizing a reticle on the insertion part, thereby preventing the pin from being damaged due to collision with the wall of the tube. As a result, the present invention is capable of simplifying the sampling procedures and is easy, safe and reliable for use.

The cell storage tube of the present invention may comprise a main body, a sealing member, a cover body and a sealing cover. The main body of the storage tube includes an accommodating chamber, an opening end and a closed end. The sealing member is disposed at the opening end of the main body and sealing the accommodating chamber. The sealing member includes an assembly part and an insertion part. The assembly part is coupled to the main body, and an end of the assembly part has a guiding chamfer slanted inward with an angle such that a lower part of the assembly part having an outer diameter gradually reduced in a downward direction. The tip of the guiding chamfer is preferably an arc-shape. The guiding chamfer guides and facilitates an insertion of the sealing member into the main body. The insertion part has a reticle arranged on a top thereof. The reticle of the insertion part may be cross-shaped and recessed inward. The reticle helps alignment of the pin so that the pin can be inserted through the center of the main body. The cover body is disposed at the opening end of the main body, and one side of the cover body is configured with a through hole. The sealing cover is disposed on a top of the cover body and detachably coupled with the cover body, wherein the sealing cover closes the through hole of the cover body when the sealing cover is combined with the main body.

In a preferred embodiment, a groove having a depth is arranged at a bottom of the assembly part. The groove is recessed upward from the bottom of the assembly part, wherein the groove of the assembly part has an inner diameter gradually reduced in an upward direction. Preferably, the inner diameter of the groove does not have to be too wide, as long as the pin is allowed to pass through. In addition, a side wall of the sealing member is configured with sufficient thickness so that the sealing member is not easily damaged and prevented from distortion and deformation when it is inserted into the main body. More preferably, the groove is configured with sufficient depth such that the insertion part at the upper part of the sealing member has a thin wall through which the user can insert the pin from the insertion part to the main body without significant effort.

Furthermore, the sealing member may include a convex part annularly protruding between the assembly part and the insertion part. The convex part abuts a periphery of the main body at the side of the opening end, such that the sealing member does not slide downward when a force is applied. Preferably, the cover body at its upper part has an inner shape that is corresponding to an outer shape of the convex part 23 and above of the sealing member 20. As a result, the cover body abuts the convex part of the sealing member such that the sealing member is secured on a top of the main body.

Preferably, the sealing member is comprised of silicon material.

The opening end of the main body may have an outer thread on an external side thereof, and the cover body may have an inner thread corresponding to the outer thread on an internal side thereof; thus, the main body and the cover body may be combined by the outer thread and the inner thread. In addition, a protrusion is configured at the opening end and annularly protruding from the external side of the main body. The protrusion is configured with a plurality of ratchet teeth at an upper part thereof, and the cover body is configured with a plurality of pawl teeth in corresponding to the ratchet teeth, the pawl teeth engage with the ratchet teeth such that the cover body is secured and locked at the opening end of the main body.

The cover body and the sealing cover may be combined by a buckle structure.

A stand part may be configured at the closed end of the main body and annularly protruding from a periphery thereof in a downward direction.

The accommodation chamber of the main body may have a cone-shaped or arc-shaped bottom.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
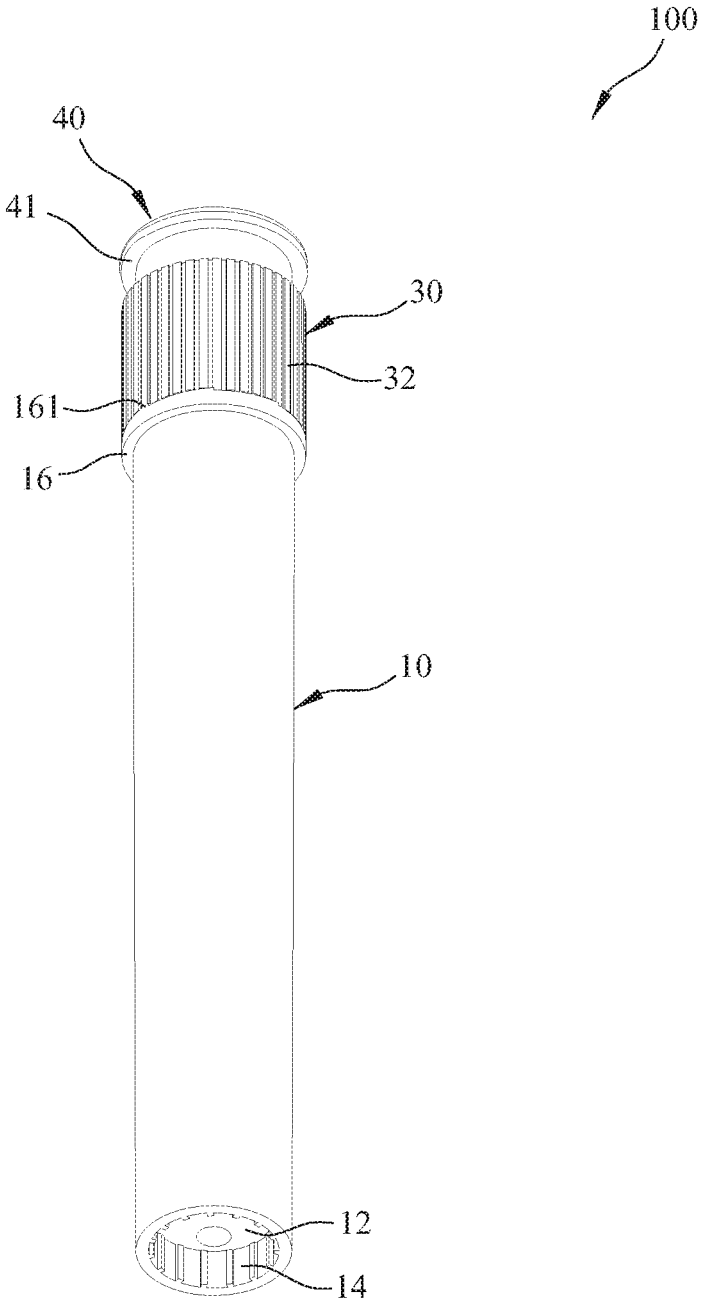
FIG. 1 is a perspective view of a cell storage tube according to an embodiment of the present invention.

The accompanying drawings are included to provide a further understanding of the invention, and are incorporated in and constitute a part of this specification. The drawings illustrate embodiments of the invention and, together with the description, serve to explain the principles of the invention.

Referring to FIGS. 1 to 5, a cell storage tube 100 of the present invention comprises a main body 10, a sealing member 20, a cover body 30 and a sealing cover 40. The main body 10 of the storage tube includes an accommodating chamber 13, an opening end 11 and a closed end 12. The sealing member 20 is disposed at the opening end 11 of the main body 10 and sealing the accommodating chamber 13. The sealing member 20 includes an assembly part 21 and an insertion part 22. The assembly part 21 has an outer diameter which is slightly larger than an inner diameter of the opening end 11 of the main body 10, such that the assembly part 21 may be tightly coupled to the main body 10. An end of the assembly part 21 has a guiding chamfer 212 slanted inward with an angle such that a lower part of the assembly 21 part has an outer diameter gradually reduced in a downward direction. A tip of the guiding chamfer 212 of the assembly 21 part is preferably an arc-shape so that it can guide and facilitate the insertion of the sealing member 20 into the main body 10. The insertion part 22 has a reticle 221 arranged on the top thereof. The reticle 221 of the insertion part 22 may be cross-shaped and recessed inward. The reticle 221 helps the alignment of the pin 200 so that the pin 200 can be inserted from the center of the main body 10, preventing the pin 200 from being damaged due to collision with the wall of the tube. The cover body 30 is disposed at the opening end 11 of the main body 10, and one side of the cover body 30 is configured with a through hole 31. The sealing cover 40 is disposed on a top of the cover body 30 and detachably coupled with the cover body 30, wherein the sealing cover 40 closes the through hole 31 of the cover body 30 when the sealing cover 40 is combined with the cover body 30.

Preferably, the insertion part 22 of the sealing member 20 protrudes from the main body 10, and an upper surface of the insertion part 22 substantially aligns with an upper periphery of the cover body 30 in height so that the insertion part 22 is exposed, helping the user to insert the pin 200. In addition, the assembly part 21 may have a groove 211 having a depth configured at a bottom of the assembly part 21. The groove 211 is recessed upward from the bottom of the assembly part 21, and the groove 211 of the assembly part 21 has an inner diameter gradually reduced in an upward direction. Preferably, the inner diameter of the groove 211 does not have to be too large, as long as the pin 200 is allowed to pass through. Meanwhile, a side wall of the sealing member 20 has sufficient thickness so that the sealing member 20 is not easily damaged and prevented from distortion and deformation when it is inserted into the main body 10. More preferably, the groove 211 has sufficient depth that the insertion part 22 at an upper part of the sealing member 20 has a thin wall through which the user can insert the pin 200 from the insertion part 22 to the main body 10 without significant effort.

Preferably, the sealing member 20 includes a convex part 23 which is configured annularly between the assembly part 21 and the insertion part 22. The convex part 23 abuts a periphery of the main body 10 at the side of the opening end 11, such that the sealing member 20 does not slide downward when a force is applied to the sealing member 20.

Preferably, the sealing member 20 is comprised of silicon material. Comprised by elastic silicon, the sealing member 20 can be easily inserted into the main body 10 for assembly. Furthermore, silicon material allows the pin 200 to penetrate there through effortlessly.

Preferably, the cover body 30 at its upper part has an inner shape that is corresponding to an outer shape of the convex part 23 and above of the sealing member 20. As a result, the cover body 30 is allowed to abut the convex part 23 such that the sealing member 20 is secured on the top of the main body 10. Moreover, the cover body 30 defines the shape of the sealing member 20, preventing the sealing member 20 made by elastic silicon from deformation when force is applied thereto.

The opening end 11 of the main body 10 may have an outer thread 15 on an external side thereof, and the cover body 30 may have an inner thread 33 corresponding to the outer thread 15 on an internal side thereof, allowing the main body 10 to be combined with the cover body 30 by the outer thread 15 and the inner thread 33. In addition, a protrusion 16 may be annularly configured at the main body 10, at a position below where the main body 10 and the cover body 30 are combined. The protrusion 16 may be configured with a plurality of ratchet teeth 161 at a side near the cover body 30, and the cover body 30 may be configured with a plurality of pawl teeth 35 in corresponding to the ratchet teeth 161. The pawl teeth 35 engage with the ratchet teeth 161 such that the cover body 30 is secured and locked at the opening end 11 of the main body 10.

The accommodation chamber 13 may form a cone shape or an arc shape at the closed end 12, allowing the user to instantaneously and conveniently extract the cells at the bottom of the accommodation chamber 13 by the pin 200. Moreover, a stand part 14 may be configured at the closed end 12 of the main body 10 and annularly protruding from a periphery thereof in a downward direction, such that the main body 10 can be appropriately placed during usage to prevent it from falling and leakage.

The cover body 30 may be configured with a plurality of ribs 32 around an external side thereof. The ribs 32 are spaced apart with each other and protruding from the cover body 30, allowing the user to easily grab the cell storage tube 100.

The top of the cover body 30 may be annularly configured with a flange 34, and an inner circumference of the sealing cover 40 may be recessed with a coupling slot 42 in corresponding to the flange 34, allowing the sealing cover 40 to be detachably secured on the cover body 30 by a buckle structure formed by the flange 34 and the coupling slot 42. In addition, a top of the sealing cover 40 may be annularly configured with a block 41 at an external side thereof, allowing the user to apply force onto the sealing cover 40 to open it. In addition, the sealing cover 40 is annularly configured with an inclined plane 43 inclining toward an inner side from a bottom periphery of the sealing cover 40. The inclined plane 43 operates as a guiding means by which the sealing cover 40 can easily slide into a correct position to be buckled with the cover body 30 without deliberate alignment.

Figure 2:
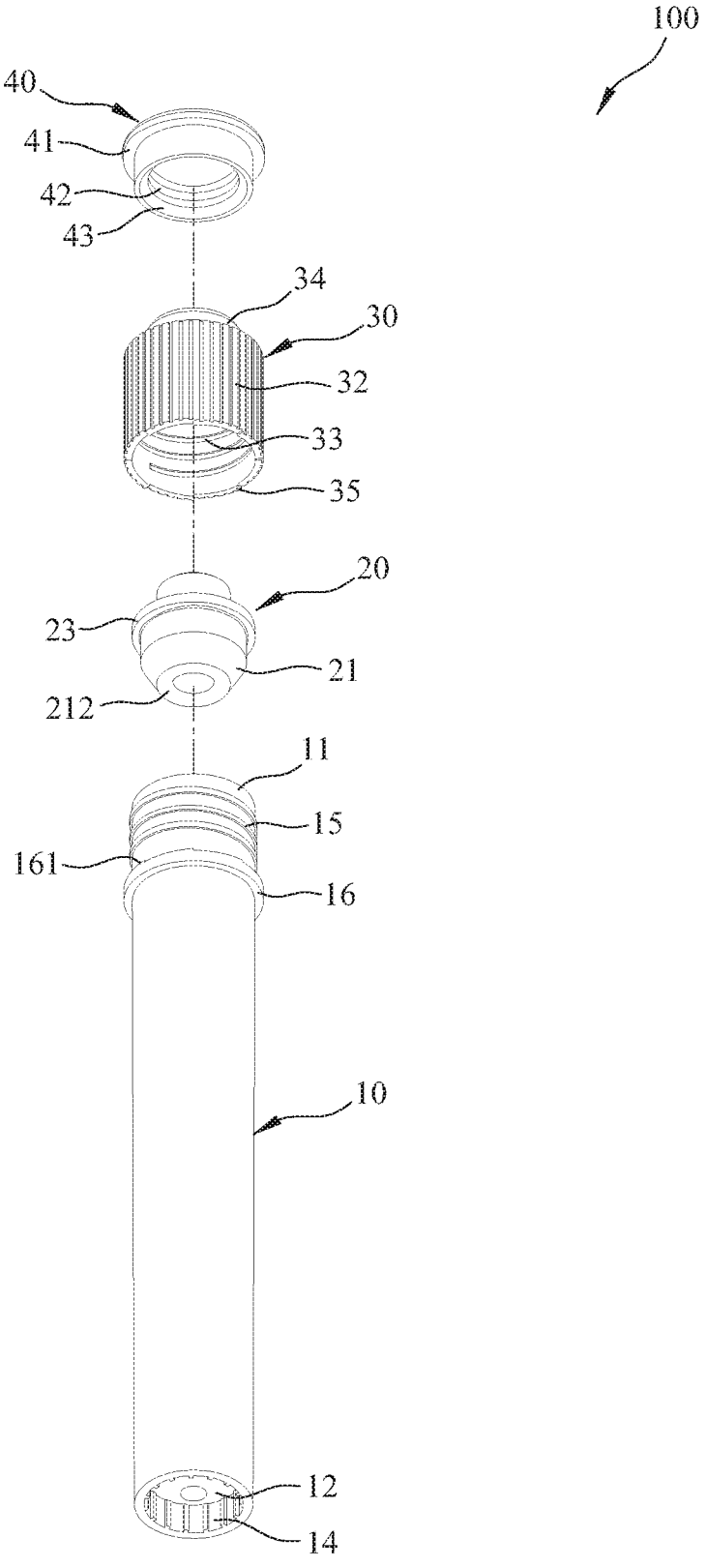
FIG. 2 is an exploded view of the cell storage tube according to the embodiment of the present invention.
Figure 3:
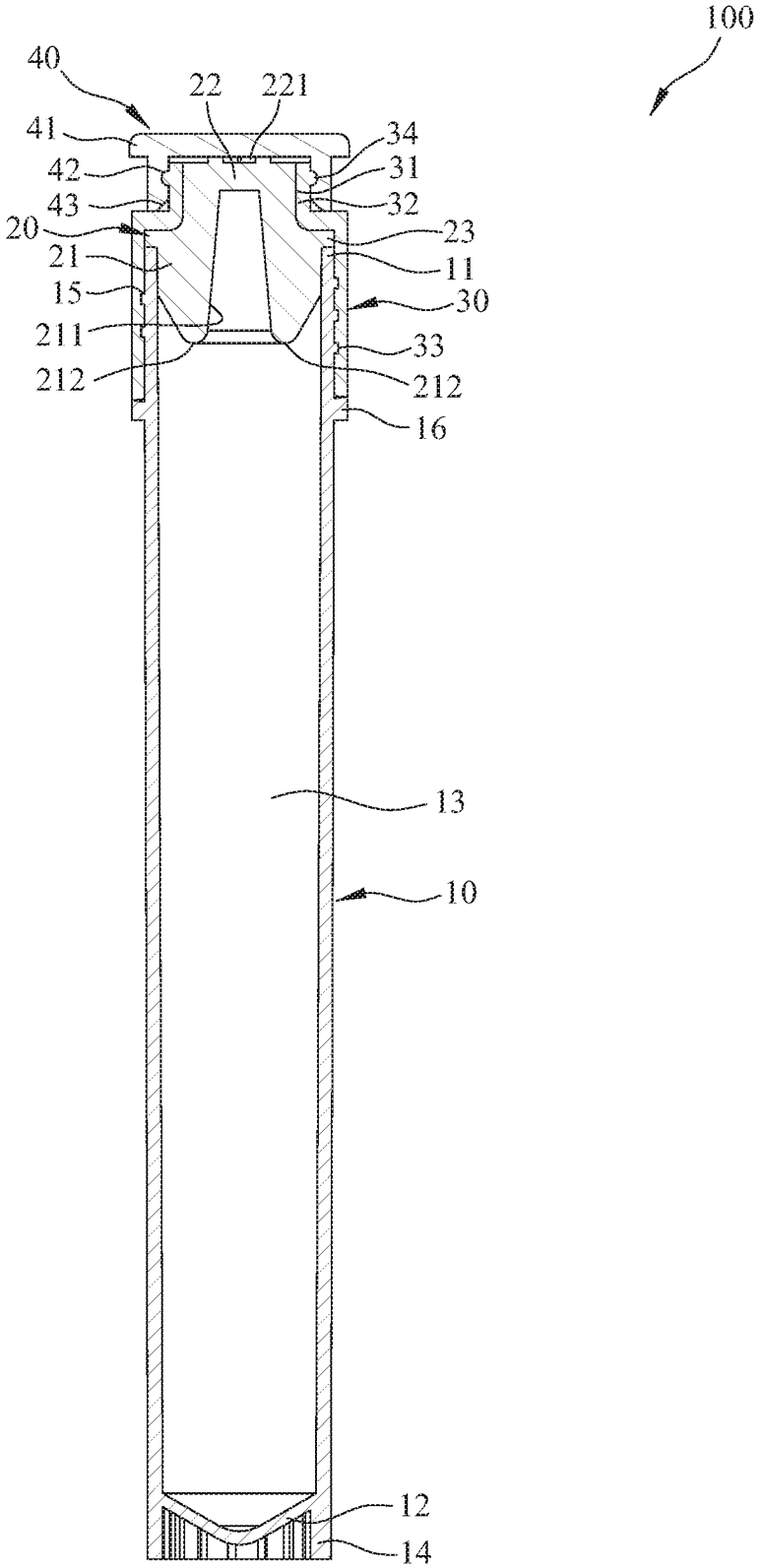
FIG. 3 is a sectional view of the cell storage tube according to the embodiment of the present invention.
Figure 4:
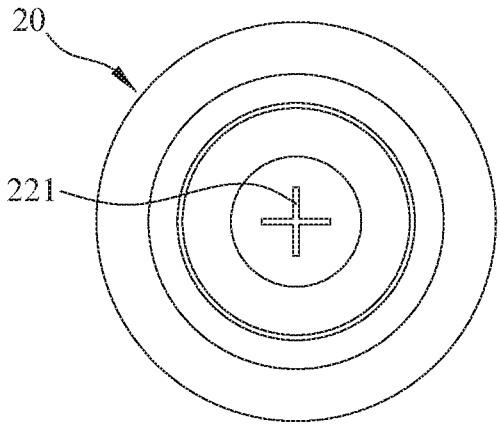
FIG. 4 is a top view of a sealing member of the cell storage tube according to the embodiment of the present invention.
Figure 5:
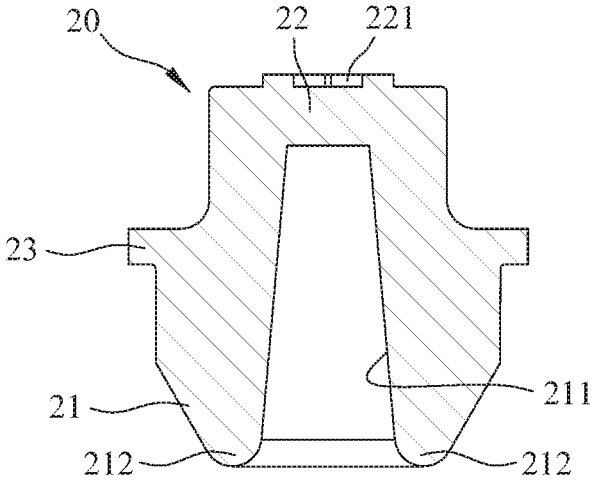
FIG. 5 is a sectional view of the sealing member of the cell storage tube according to the embodiment of the present invention.

Referring to FIG. 2, which is an exploded view of the cell storage tube 100 according to the embodiment of the present invention. In particular, when the cell storage 100 is for use, cells are first extracted from human body, cultured and then placed into the main body 10. By the guiding chamfer 212 of the sealing member 20, it is easy to insert the sealing member 20 into the main body 10 to close the accommodation chamber 13 of the main body 10. Meanwhile, since the side wall of the sealing member 20 has sufficient thickness, the sealing member 20 is prevented from damage and deformation during insertion. After the accommodation chamber 13 of the main body 10 is sealed by the sealing member 20, the cover body 30 and the main body 10 are combined by the outer thread 15 and the inner thread 33, and the sealing member 20 is secured on the top of the main body 10. Next, the sealing cover 40 is buckled on the top of the cover body 30 by the buckle structure, sealing the sealing member 20. Finally, the cell storage tube 100 is placed into a barrel with liquideous nitrogen to be frozen and adequately stored.

Figure 6:
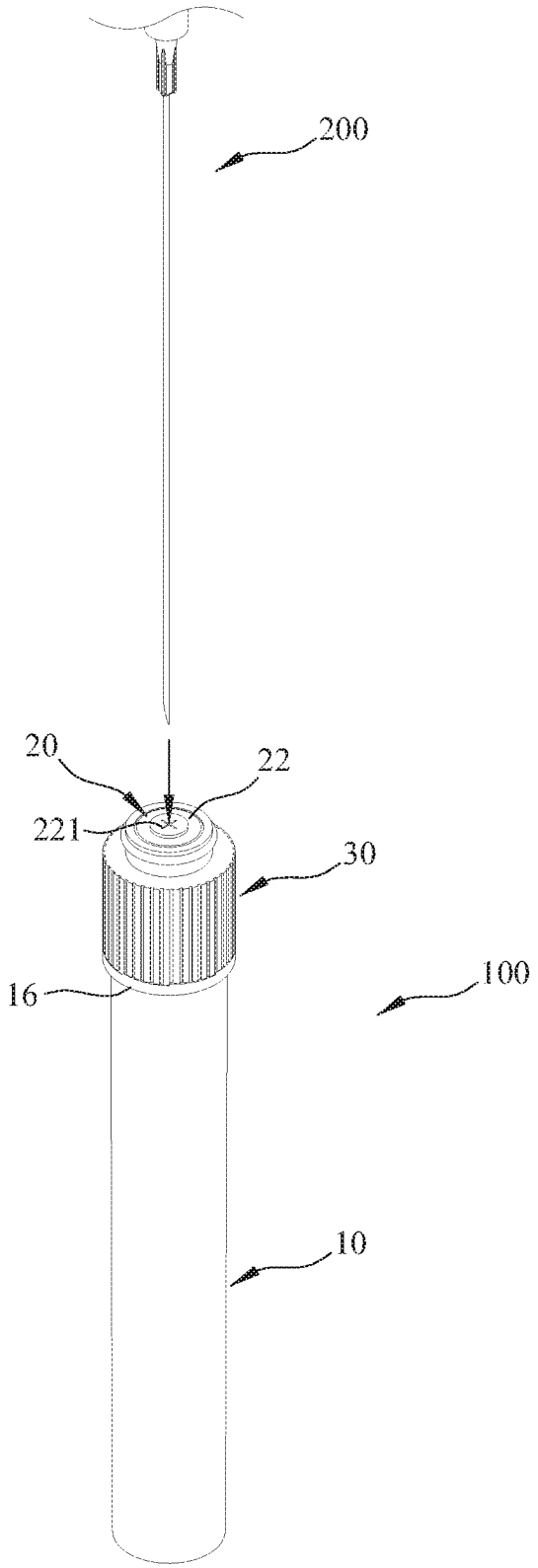
FIG. 6 is a schematic view illustrating an usage of the cell storage tube according to the embodiment of the present invention.
Figure 7:
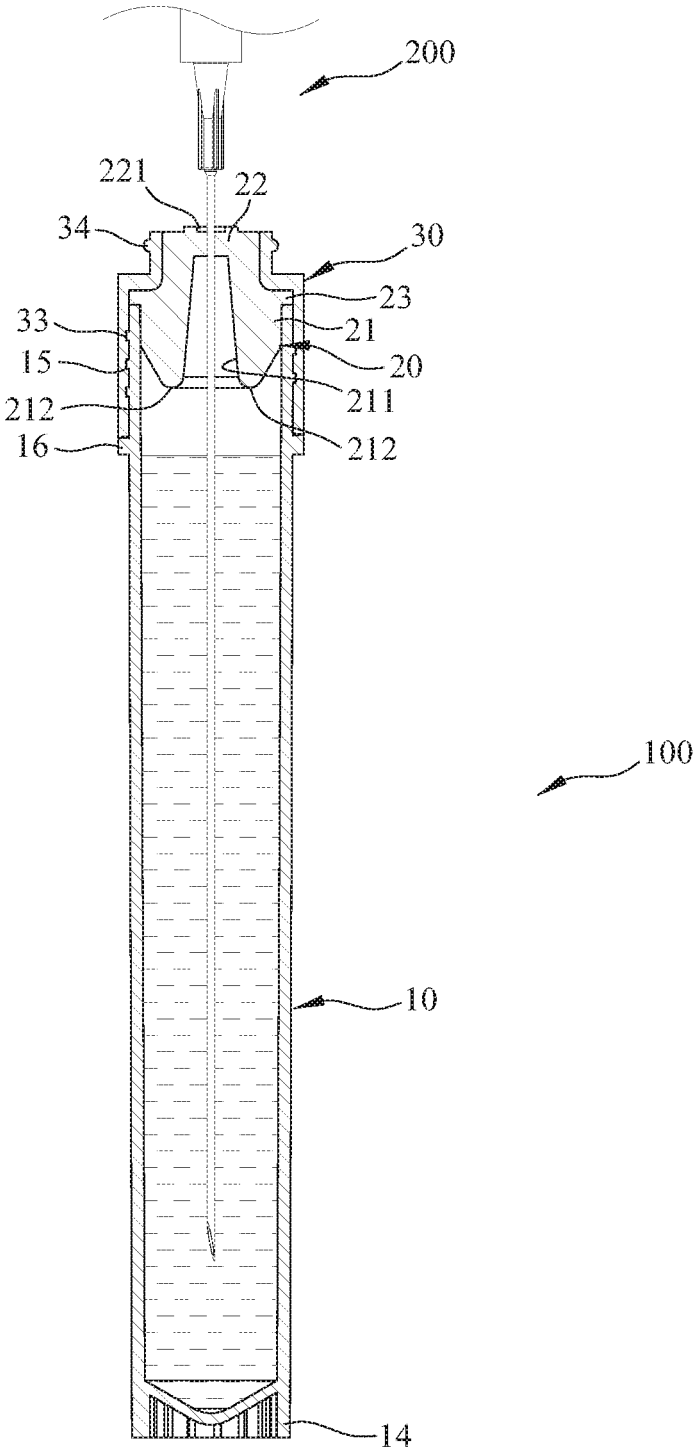
FIG. 7 is a schematic view illustrating the usage of the cell storage tube according to the embodiment of the present invention.

Referring to FIGS. 6 and 7, when cell extraction is needed, the cell storage tube 100 is taken out from the liquideous nitrogen barrel. The sealing cover 40 is opened to expose the insertion part 22 of the sealing member 20, and the pin 200 is aligned with the center of the cross-shaped reticle 221 for insertion. Once the pin 200 is inserted and accesses into the accommodation chamber 13 of the main body 10, the cells can be extracted for usage. After extraction, the sealing cover 40 is put back to cover the sealing member 20 and finally the cell storage tube 100 is put into the liquideous nitrogen barrel to be stored for the next use.

It is apparent that the cell storage tube 100 of the present invention has the following beneficial effects:

The cell storage tube 100 of the present invention allows sampling of cells to be performed in a hermetic condition, thereby preventing the cells remained in the cell storage tube 100 from contamination.

The cell storage tube 100 of the present invention allows easy and fast assembly. By utilizing the guiding chamfer 212 of the sealing member 20, the sealing member 20 can be effortlessly inserted into the main body 10.

The cell storage tube 100 of the present invention allows cell extraction by directly inserting the pin 200 into the sealing member 20 without opening the cover body 30, thereby simplifying the sampling procedures.

The cell storage tube 100 of the present invention has the reticle 212 at the insertion part 22 of the sealing member 20, helping the user to aim the center of the insertion part 22 for insertion, thereby preventing the pin 200 from damage due to collision with the wall of the main body 10.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A cell storage tube, comprising:

a main body of the storage tube including an accommodating chamber, an opening end and a closed end;

a sealing member disposed at the opening end of the main body and sealing the accommodating chamber, the sealing member including an assembly part and an insertion part, the assembly part coupled to the main body, an end of the assembly part having a guiding chamfer slanted inward with an angle such that a lower part of the assembly part having an outer diameter gradually reduced in a downward direction, and the insertion part having a reticle arranged on a top thereof;

a cover body disposed at the opening end of the main body, and one side of the cover body configured with a through hole; and a sealing cover disposed on a top of the cover body and detachably coupled with the cover body, wherein the sealing cover closes the through hole of the cover body when the sealing cover is combined with the main body.

2. The cell storage tube according to claim 1, wherein the reticle of the insertion part is cross-shaped and recessed inward.

3. The cell storage tube according to claim 1, wherein a groove having a depth is arranged at a bottom of the assembly part, the groove is recessed upward from the bottom of the assembly part.

4. The cell storage tube according to claim 3, wherein the groove of the assembly part has an inner diameter gradually reduced in an upward direction.

5. The cell storage tube according to claim 1, wherein the sealing member includes a convex part annularly protruding between the assembly part and the insertion part, the convex part abuts a periphery of the main body at the side of the opening end.

6. The cell storage tube according to claim 1, wherein the guiding chamfer has an arc-shaped tip.

7. The cell storage tube according to claim 1, wherein the sealing member is comprised of silicon material.

8. The cell storage tube according to claim 5, wherein the cover body at its upper part has an inner shape that is corresponding to an outer shape of the convex part and above of the sealing member.

9. The cell storage tube according to claim 1, wherein the opening end of the main body has an outer thread on an external side thereof, and the cover body has an inner thread corresponding to the outer thread on an internal side thereof, the main body and the cover body is combined by the outer thread and the inner thread.

10. The cell storage tube according to claim 9, wherein a protrusion is configured at the opening end of the main body and annularly protruding from the external side of the opening end of the main body; the protrusion is configured with a plurality of ratchet teeth at an upper part thereof and the cover body is configured with a plurality of pawl teeth in corresponding to the ratchet teeth, the pawl teeth engage with the ratchet teeth such that the cover body is secured and locked at the opening end of the main body.

11. The cell storage tube according to claim 1, wherein the cover body and the sealing cover are combined by a buckle structure.

12. The cell storage tube according to claim 1, wherein a stand part is configured at the closed end of the main body and annularly protruding from a periphery thereof in a downward direction.

13. The cell storage tube according to claim 1, wherein the accommodation chamber of the main body has a cone-shaped or arc-shaped bottom.

* * * * *